US011255618B2

(12) United States Patent
Nakamura et al.

(10) Patent No.: US 11,255,618 B2
(45) Date of Patent: Feb. 22, 2022

(54) FLAT EXTRUDED ALUMINUM MULTI-PORT TUBE WHOSE INNER SURFACE IS HIGHLY CORROSION-RESISTANT AND AN ALUMINUM HEAT EXCHANGER USING THE TUBE

(71) Applicants: UACJ CORPORATION, Tokyo (JP); UACJ EXTRUSION CORPORATION, Tokyo (JP); DENSO CORPORATION, Kariya (JP)

(72) Inventors: Shinichi Nakamura, Tokyo (JP); Naoki Yamashita, Tokyo (JP); Seiichi Nagao, Nagoya (JP); Satoshi Shibata, Tokyo (JP); Kazuhisa Naitou, Kariya (JP); Takeshi Okinotani, Kariya (JP); Susumu Ichikawa, Kariya (JP); Akira Itoh, Kariya (JP)

(73) Assignees: UACJ CORPORATION, Tokyo (JP); UACJ EXTRUSION CORPORATION, Tokyo (JP); DENSO CORPORATION, Kariya (JP)

( * ) Notice: Subject to any disclaimer, the term of this patent is extended or adjusted under 35 U.S.C. 154(b) by 190 days.

(21) Appl. No.: 16/718,717

(22) Filed: Dec. 18, 2019

(65) Prior Publication Data

US 2020/0124362 A1 Apr. 23, 2020

Related U.S. Application Data

(60) Division of application No. 15/889,769, filed on Feb. 6, 2018, now abandoned, which is a continuation of (Continued)

(51) Int. Cl.

*F28F 19/06* (2006.01)
*B21C 23/22* (2006.01)

(Continued)

(52) U.S. Cl.

CPC ..... *F28F 19/06* (2013.01); *B21C 23/085* (2013.01); *B21C 23/22* (2013.01); *C22C 21/10* (2013.01);

(Continued)

(58) Field of Classification Search

CPC ..... F28F 19/06; F28F 1/022; F28F 21/084; F28F 2255/16; B21C 23/085; B21C 23/22; C22C 21/10

See application file for complete search history.

(56) References Cited

U.S. PATENT DOCUMENTS 5,567,493 A * 10/1996 Imai ..... B21C 23/085 428/36.9
6,536,255 B2 * 3/2003 Kraft ..... F28D 1/05383 165/177

(Continued)

FOREIGN PATENT DOCUMENTS

JP H05-222480 A 8/1993
JP H06-1 42755 A 5/1994

(Continued)

OTHER PUBLICATIONS

Nov. 1, 2016 International Search Report issued in International Patent Application No. PCT/JP2016/073569.

*Primary Examiner* — Jon T. Schermerhorn, Jr.
(74) *Attorney, Agent, or Firm* — Oliff PLC

(57) ABSTRACT

In this flat extruded aluminum multi-port tube, the corrosion-resistance, at inner surfaces of a plurality of flow passages independently and parallelly extending in the tube axial direction, is effectively enhanced. In a flat extruded aluminum multi-port tube 10 formed by an extrusion by employing an aluminum tube material and an aluminum sacrificial anode material having an electrochemically lower potential than the aluminum tube material, the aluminum sacrificial anode material is exposed to form a sacrificial (Continued)

anode portion 18 at least in a part of an inner circumferential portion in each of the plurality of flow passages 12.

8 Claims, 5 Drawing Sheets

Related U.S. Application Data application No. PCT/JP2016/073569, filed on Aug. 10, 2016.

(51) Int. Cl.

| | |
|---|---|
| ***C22C 21/10*** | (2006.01) |
| ***F28F 21/08*** | (2006.01) |
| ***C22C 21/12*** | (2006.01) |
| ***F28F 1/04*** | (2006.01) |
| ***B21C 23/08*** | (2006.01) |
| ***F28F 1/02*** | (2006.01) |
| ***C23F 13/08*** | (2006.01) |

(52) U.S. Cl.

CPC ..... *C22C 21/12* (2013.01); *C23F 13/08* (2013.01); *F28F 1/022* (2013.01); *F28F 1/04* (2013.01); *F28F 21/084* (2013.01); *C23F 2201/00* (2013.01); *C23F 2213/32* (2013.01); *F28F 2255/16* (2013.01)

(56) References Cited

U.S. PATENT DOCUMENTS

| | | | | |
|---|---|---|---|---|
| 7,588,073 | B2 * | 9/2009 | Hyogo | B21C 37/151 165/177 |
| 7,732,059 | B2 * | 6/2010 | Ren | B21C 23/085 428/654 |
| 2006/0118282 | A1 * | 6/2006 | Ren | B21C 23/085 165/133 |
| 2007/0017605 | A1 * | 1/2007 | Nakamura | C22F 1/08 148/550 |
| 2007/0034366 | A1 * | 2/2007 | Igami | F28D 1/0391 165/177 |

FOREIGN PATENT DOCUMENTS

| | | | |
|---|---|---|---|
| JP | 2014-095524 | A | 5/2014 |
| WO | 2013/125625 | A1 | 8/2013 |

* cited by examiner

FLAT EXTRUDED ALUMINUM MULTI-PORT TUBE WHOSE INNER SURFACE IS HIGHLY CORROSION-RESISTANT AND AN ALUMINUM HEAT EXCHANGER USING THE TUBE

CROSS REFERENCE TO RELATED APPLICATION

This application is a divisional application of U.S. application Ser. No. 15/889,769, filed Feb. 6, 2018, which is a continuation of the International Application No. PCT/JP2016/073569 filed on Aug. 10, 2016, which claims the benefit under 35 U.S.C. § 119(a)-(d) of Japanese Application No. 2015-159193 filed on Aug. 11, 2015, and Japanese Application No. 2016-123855 filed on Jun. 22, 2016, the entireties of which are incorporated herein by reference.

BACKGROUND OF THE INVENTION

Field of the Invention

The present invention relates to a flat extruded aluminum multi-port tube whose inner surface is highly corrosion-resistant, and an aluminum heat exchanger using the tube. Specifically, the invention relates to a flat extruded aluminum multi-port tube excellent in corrosion-resistance of inner surfaces of flow passages through which a cooling liquid is passed, which tube may be advantageously used as a heat transfer tube in a heat exchanger, in particular a heat exchanger for automobiles, such as an automobile air conditioner and a radiator. The invention also relates to an aluminum heat exchanger obtained by using the above-described tube.

Description of Related Art

Conventionally, in heat exchangers such as a radiator and a heater wherein a heat transfer tube functions as a flow passage for a cooling liquid, the heat transfer tube is prepared by bending a plate member to form the tube. On the surface of the plate member which defines an inner surface of the tube, a sacrificial material is cladded, so that corrosion of the inner surface of the heat transfer tube is prevented. In particular, it is effective to increase the number of the flow passages for improving the properties of the heat transfer tube made by the plate, so that the plurality of flow passages are formed inside the tube by arranging inner fins. However, such configuration has a lot of joining points, giving rise to potential problems of brazing joint deficiency and possibility of burst due to an insufficient pressure-resistance. Moreover, there is an inherent problem that a flux used in the brazing operation may cause clogging of the flow passages formed inside the tube. To solve these problems, it is preferable to use a flat extruded multi-port tube whose partition walls of each flow passage are not joined by brazing, and which is produced without using the flux.

Such flat extruded multi-port tubes are generally produced by subjecting aluminum or an aluminum alloy to porthole extrusion. Examples of the cross sectional shape of the flat multi-port tubes are disclosed in JP-A-H6-142755 (Patent Document 1), JP-A-H5-222480 (Patent Document 2), and WO2013/125625 (Patent Document 3).

In the flat extruded multi-port tube used as a heat transfer tube for a heat exchanger, the cooling liquid is passed though the internal flow passages (passageways). This tube has an inherent problem of corrosion of the inner surfaces of the flow passages due to the cooling liquid. Where corrosion holes penetrating a tubular wall (peripheral wall) of the tube are generated because of a progress of the corrosion, the function of the heat exchanger is lost completely.

For this reason, with respect to the above-described flat extruded multi-port tube, as is disclosed in the above-described document JP-A-H5-222480 (Patent Document 2), it is proposed to extrude only a given aluminum alloy having a specific composition so that the flat extruded multi-port tube has a sufficient corrosion-resistance. However, such tube does not exhibit the sufficient corrosion-resistance with respect to the inner surface of the flow passages, failing to meet recent high demands for the corrosion-resistance. Furthermore, since the tube is wholly made of the aluminum alloy of the specific composition, there is an inherent problem that the properties of the obtained tube are limited by the aluminum alloy having such specific composition.

SUMMARY OF THE INVENTION

Under these circumstances, the inventors made a thorough research in order to improve an internal corrosion-resistance of a plurality of flow passages extending independently of each other in an axial direction of a tube in a flat extruded aluminum multi-port tube obtained by extruding an aluminum material. As a result, they have found that hot-extruding an aluminum material comprising a conventional aluminum tube material and an aluminum sacrificial anode material having an electrochemically lower potential than the aluminum tube material permits a sacrificial anode portion consisting of the sacrificial anode material to be advantageously exposed to the inner surface of the passages of the flat multi-port tube, whereby an excellent internal corrosion-resistance can be imparted to the flow passages of the flat multi-port tube owing to a sacrificial anode effect exhibited by the existence of the sacrificial anode portion.

The present invention was made in view of the background art described above. It is therefore a problem to be solved by the invention to provide an extruded multi-port tube with a generally flat cross sectional shape obtained by extruding an aluminum material, which is configured to permit an effective increase of the corrosion-resistance of the inner surface of its flow passages extending independently of each other parallelly in an axial direction of the tube. It is another problem to be solved by the invention to provide a flat extruded aluminum multi-port tube wherein the corrosion-resistance of the inner surface of its flow passages is drastically improved owing to a sacrificial anode effect, and an aluminum heat exchanger which is obtained by using the flat multi-port tube and is excellent in the corrosion-resistance.

The above-described problem can be solved according to a principle of the invention which provides an aluminum multi-port tube with a generally flat cross sectional shape obtained by extruding an aluminum material, the aluminum multi-port tube being an extruded tube which has a plurality of flow passages extending independently of each other in an axial direction of the tube, the flow passages being arranged in a longitudinal direction of the flat cross sectional shape via internal partition wall portions extending in the axial direction of the tube in a peripheral wall portion of the tube, characterized in that the aluminum multi-port tube is formed by extrusion wherein an aluminum tube material and an aluminum sacrificial anode material having an electrochemically lower potential than the aluminum tube material are employed as said aluminum material, and the aluminum sacrificial anode material is exposed to form a sacrificial anode portion at least in a part of an inner circumferential portion in cross section of each of the plurality of flow passages, whereby the aluminum multi-port tube has an excellent internal corrosion-resistance.

In the invention, preferably, the sacrificial anode portion exists at the internal partition wall portion positioned between adjacent ones of the plurality of flow passages, in a ratio not higher than 100% of a thickness of the internal partition wall portion, and in a ratio not higher than 90% of a thickness of the peripheral wall portion at a peripheral wall portion other than the internal partition wall portions.

In one preferable embodiment of the aluminum multi-port tube according to the invention, a difference of a potential between the aluminum sacrificial anode material and the aluminum tube material is not less than 5 mV and not more than 300 mV.

Furthermore, in the invention, it is preferable that the sacrificial anode portion is formed along at least 10% of a peripheral length of each flow passage in cross section of the tube, and exposed to an inner surface of the flow passage.

In addition, according to another preferable embodiment of the invention, the internal partition wall portions positioned at opposite end portions in the longitudinal direction of the flat cross sectional shape, among the internal partition wall portions existing between adjacent ones of the plurality of flow passages, have a larger thickness than that of the other internal partition wall portions.

In a further preferable embodiment of the aluminum multi-port tube according to the invention, the internal partition wall portion positioned between adjacent ones of the plurality of flow passages extends with a thickness increasing continuously or stepwise from the thinnest part of the internal partition wall portion toward opposite sides of the peripheral wall portion which are joined by the internal partition wall portion, and are joined to said opposite sides of the peripheral wall portion by connecting parts having a thickness larger than that of the thinnest part of the internal partition wall portion.

It is another principle of the invention to provide an aluminum heat exchanger comprising the above-described aluminum multi-port tube according to the invention and aluminum outer fins brazed on an outer surface of the aluminum multi-port tube.

In the flat extruded aluminum multi-port tube according to the present invention, the sacrificial anode portion formed of the aluminum sacrificial anode material is exposed to the inner surface of the plurality of flow passages extending independently of each other in the axial direction of the tube, whereby the corrosion-resistance of the inner surface is improved owing to the sacrificial anode effect. For this reason, the flat multi-port tube is advantageously used as a heat transfer tube for a heat exchanger such as a radiator and a heater, whose inner surfaces define the flow passages of the cooling agent.

In addition, since the flat extruded aluminum multi-port tube according to the invention comprises the aluminum tube material and the aluminum sacrificial anode material and is produced by simultaneous extrusion or co-extrusion of the two materials, desired properties of the tube are achieved by the aluminum tube material, while the internal corrosion-resistance of the tube is effectively improved by the aluminum sacrificial anode material. Thus, the tube has an advantage of effective improvement of the freedom of design of the flat extruded multi-port tube to be obtained.

Furthermore, in the aluminum heat exchanger wherein the flat extruded aluminum multi-port tube according to the invention and the aluminum outer fins are assembled together and joined to each other by brazing, the excellent internal corrosion-resistance of the flat extruded aluminum multi-port tube permits also the corrosion-resistance of the heat exchanger to be advantageously improved.

BRIEF DESCRIPTION OF DRAWINGS

FIGS. 1A, 1B and 1C are schematic cross sectional views showing a flat aluminum extruded multi-port tube according to one embodiment of the present invention, in which FIG. 1A is a whole view, FIG. 1B is an enlarged view showing a part of the tube, and FIG. 1C is an enlarged view which shows one example wherein a sacrificial anode portion is exposed in a different ratio;

FIG. 2B shows a view corresponding to the embodiment shown in FIG. 1B;

FIGS. 3A, 3B and 3C are schematic cross sectional views showing various forms of the internal partition wall portions in the flat aluminum extruded multi-port tube according to the present invention, in which FIGS. 3A, 3B and 3C show different examples of the internal partition wall portions;

MODES FOR CARRYING OUT THE INVENTION

To further clarify the present invention, representative embodiments of the invention will be described in detail by reference to the drawings.

Figure 1A:
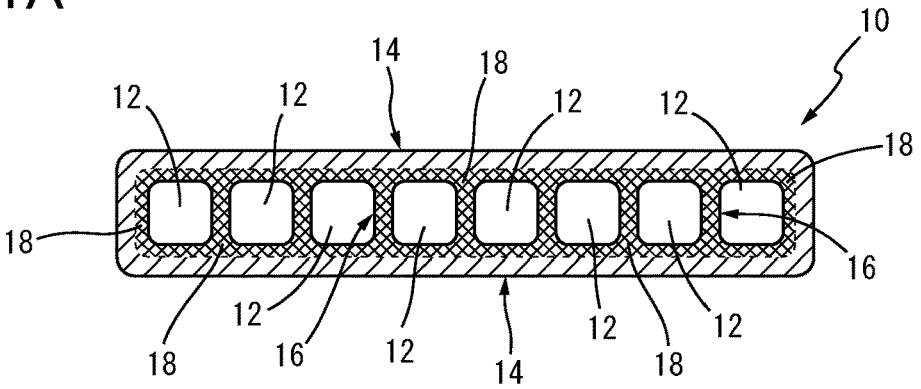
Figure 1B:
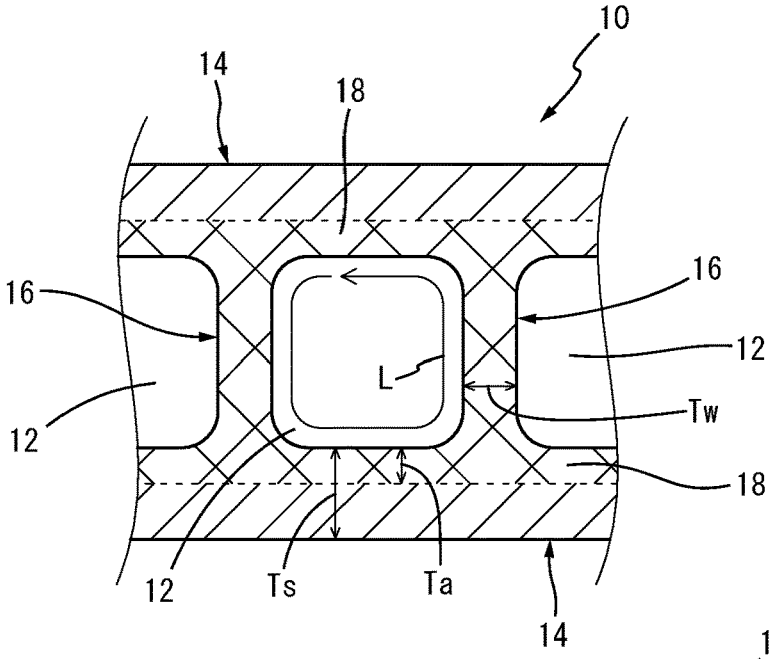
Figure 1C:
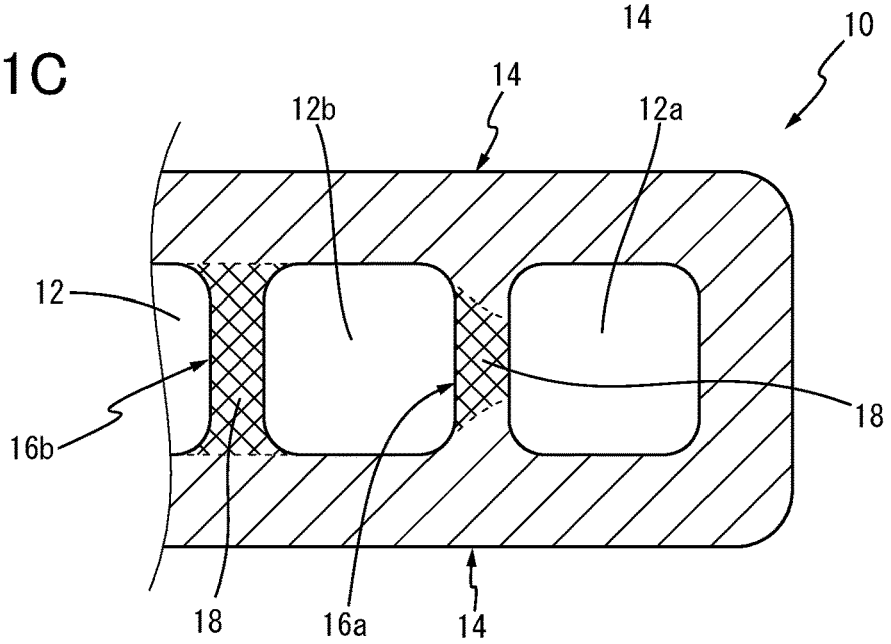

Referring first to the schematic cross sectional views of FIGS. 1A, 1B and 1C there is shown one example of a flat aluminum extruded multi-port tube according to this invention, in a transverse plane perpendicular to a longitudinal direction (axial direction) of the tube. The multi-port tube 10 according to the invention is an extruded tube having a generally flat cross sectional shape made of an aluminum material and has a plurality of flow passages 12 in the form of rectangular holes extending independently of each other in parallel to the axial direction of the tube, the plurality of flow passages 12 being arranged at a predetermined interval in the longitudinal direction of the flat shape (left and right direction in the figures). The upper and lower outer surfaces of the multi-port tube 10 are flat surfaces to which conventional outer fins (not shown in the figures) made of aluminum or an aluminum alloy, such as plate fins and corrugated fins, are joined by brazing or other joining methods, so as to be used as a heat exchanger. While the transverse sectional shape of the flow passage 12 is the rectangular shape in this example, various other known shapes such as circle, oval, triangle, trapezoid or combinations thereof can be employed.

In the invention, as is apparent from FIG. 1A, the flat multi-port tube 10 having the above-described structure is configured such that at least an outer part of a peripheral wall portion 14 of the tube 10 is formed of a conventional aluminum tube material, while a sacrificial anode portion 18 made of an aluminum sacrificial anode material is provided around each flow passage 12 including an internal partition wall portion 16 positioned between the adjacent flow passages 12, 12. The sacrificial anode portion 18 is exposed to at least a part of the periphery of the flow passage 12 (the entirety of the periphery in this example). As shown in the figure, the peripheral wall portion 14 constitutes an external peripheral wall of the flat multi-port tube 10, and serves as an external partition wall for each of the flow passages 12. Furthermore, as shown in FIG. 1B, such sacrificial anode portion 18 exists in the internal partition wall portion 16 in a ratio not higher than 100% of a thickness Tw of the internal partition wall portion 16, the lower limit being at least not smaller than 1%, preferably 5% of the thickness Tw of the internal partition wall portion 16. By providing the internal partition wall portion 16 by the sacrificial anode portion 18, the internal partition wall portion 16 is preferentially subjected to a progress of corrosion due to a sacrificial anode effect, thereby exhibiting an advantageous effect to suppress or prevent penetration caused by the corrosion of the peripheral wall portion 14, which penetration would cause early leakage of a cooling liquid.

On the other hand, in the case where the sacrificial anode portion 18 exists in the peripheral wall portion 14 other than the internal partition wall portion 16, it exists in a ratio not higher than 90%, preferably 80% of a thickness Ts of the peripheral wall portion 14, the lower limit being at least not smaller than 1%, preferably 5% of the thickness Ts of the peripheral wall portion 14. That is to say, $Ta \leq 0.9 \times Ts$, and preferably $Ta \geq 0.01 \times Ts$. Where the thickness of the sacrificial anode portion 18 exceeds 90% of the thickness Ts of the peripheral wall portion 14, the thickness of the peripheral wall portion 14 may be too small after consumption of the sacrificial anode portion 18 due to the corrosion, thereby causing decrease of a pressure-resistance of the flat multi-port tube 10, and other problems.

The above-described sacrificial anode portion 18 is exposed to an entire inner surface of each of the plurality of flow passages 12 arranged in the flat multi-port tube 10. Preferably, the sacrificial anode portion 18 is exposed to the inner surface of each of the flow passages 12 continuously in the axial direction of the tube. However, the sacrificial anode portion 18 may be exposed partially discontinuously, or exposed continuously for a predetermined distance in the axial direction of the tube at a plurality of positions in the tube circumferential direction. In the invention, a configuration wherein the sacrificial anode portion 18 is always exposed to the inner surface of the flow passage 12 in any transverse section of the flat multi-port tube 10 is advantageously employed.

Furthermore, with respect to a region of exposure of the sacrificial anode portion 18 to the inner surface of the flow passage 12, the sacrificial anode portion 18 is preferably configured such that it is exposed within a range equivalent to at least not smaller than 10%, preferably 30%, more preferably 50% of a peripheral length L in the transverse section of the flow passage 12 shown in FIG. 1B. The corrosion-resistance owing to the sacrificial anode effect advantageously increases with an increase of the exposure region of the sacrificial anode portion 18 along the peripheral length L of the flow passage 12. Specifically, the most preferable embodiment is the case where the sacrificial anode portion 18 exists along the entirety of the peripheral length L of the flow passage 12. It is noted that the exposure regions of the sacrificial anode portion 18 for all of the flow passages 12 are not required to be equal to each other, and that the sacrificial anode portion 18 may be exposed in different exposure ratios with respect to the respective different flow passages 12, for example, as shown in FIG. 1C.

It is noted that the aluminum sacrificial anode material used in the invention has a lower potential than that of the aluminum tube material. Thus, the difference of the potential between those two materials exceeds 0 mV, and preferably falls within a range of not lower than 5 mV and not higher than 300 mV. The difference of the potential not lower than 5 mV permits stable exhibition of the sacrificial anode effect even under severer circumstances. On the other hand, the difference of the potential over 300 mV causes a prominent sacrificial anode effect, resulting in problems of excessive consumption of the sacrificial anode material due to the corrosion, and the like. As is apparent from the above, the sacrificial anode portion 18 having the lower potential than that of the peripheral wall portion 14 and the like consisting of the aluminum tube material permits an effective sacrificial anode effect and more advantageous realization of the corrosion-resistance of the inner surface of the flow passage.

In the above-described flat multi-port tube 10, conventional aluminum materials used in production of flat extruded multi-port tubes can be employed as the tube material constituting at least the external peripheral part of the peripheral wall portion 16. For example, materials such as 1000 series pure aluminum and 3000 series aluminum alloy according to JIS can be employed. Further, a predetermined amount of Cu may be added as an alloy component so as to increase the potential. Furthermore, as the sacrificial anode material providing the sacrificial anode portion 18, known aluminum alloy material having a lower potential than that of the above-described tube material, namely, having a lower natural potential, may be employed. For example, an aluminum alloy comprising a predetermined amount of Zn may be employed.

The above-described flat multi-port tube 10 according to the invention is produced by co-extruding the above-described tube material and sacrificial anode material as the aluminum materials to be extruded, which tube material and sacrificial anode material are employed in the form of a composite billet having a sheath-core structure. Specifically, the composite billet has a structure wherein the sacrificial anode material is disposed within a hollow portion provided in the inside (a central portion) of the tube material. The sacrificial anode material has a cross sectional shape corresponding to the hollow portion, for example, a rectangle (including one with curved corners), circle, ellipse, oval, a combination of ellipse, oval and polygon, with the cross sectional dimensions being optimized. The tube material and the sacrificial anode material are united and integrated by welding or other joining method, such that a sheath portion consisting of the tube material is formed around a core portion consisting of the sacrificial anode material. To produce the composite billet, various known methods as follows may be employed: a method wherein a sheath billet is obtained by providing a through-hole of a predetermined size in a central part of a billet formed of the tube material, and a core billet formed of the sacrificial anode material is inserted in the through-hole, and joined with the sheath billet; and a method wherein the above-described sheath billet is divided into two pieces, the core billet is placed in a hollow portion defined by the two pieces, and all of the members are fixed and joined together, for example by welding or other joining method.

Furthermore, the above-described composite billet is subjected to a hot extrusion as in the case of the conventional flat multi-port tube production, using a so-called port-hole die with a plurality of extruding ports, so as to obtain a desired flat multi-port tube. When the hot extrusion is performed, the composite billet is arranged such that, in terms of the die with the longitudinal extruding ports corresponding to the plurality of flow passages of the flat multi-port tube, the longitudinal direction in the predetermined cross sectional shape of the sacrificial anode material placed in the inside of the composite billet coincides with the longitudinal direction of the extruding ports of the die. Thus, the composite billet is subjected to the hot extrusion. The above-described method of extrusion of the composite billet with the port-hole die permits effective distribution of the sacrificial anode material within the composite billet as far as to partition walls defining the flow passages positioned at the opposite end portions of the flat cross sectional shape of the obtained multi-port tube, so that the sacrificial anode portion is advantageously exposed to the inner surfaces of the flow passages.

The flat aluminum extruded multi-port tube according to the invention produced by co-extruding or extruding the aluminum tube material and the aluminum sacrificial anode material simultaneously as described above has a structure wherein ratios (areas) of the sacrificial anode portion 18 exposed to the flow passages vary depending upon the location of the flow passages 12, as shown in the above-described FIG. 1C, so that degrees of corrosion of the sacrificial anode portion 18 are likely to vary at the internal partition wall portions 16. More particularly, the flow passages 12*a* at the opposite end portions as seen in the longitudinal direction of the flat cross sectional shape of the multi-port tube 10, namely, as seen in the width direction of the tube 10, have a lower ratio (area) of exposure of the sacrificial anode portion 18 than the other flow passages 12*b* positioned in the relatively central portion in the longitudinal direction of the flat cross sectional shape, whereby the internal partition wall portions 16*a* partially defining the flow passages 12*a* and the internal partition wall portions 16*b* of the flow passages 12*b* positioned in the relatively central portion in the longitudinal direction of the flat cross sectional shape are subjected to different degrees of corrosion of the sacrificial anode portion 18. For this reason, in the invention, it is preferable that, as shown in FIG. 2A, a thickness Twe of the internal partition wall portions 16*a* which are positioned at the opposite end portions in the width direction of the flat multi-port tube 10 and which partially define the flow passages 12*a* at those opposite end portions is made larger than a thickness Twi of the other internal partition wall portions 16*b* positioned at the relatively central portion in the width direction, so as to assure a sufficient thickness of the internal partition wall portions 16*a* at the opposite end portions remaining after corrosion.

Figure 2A:
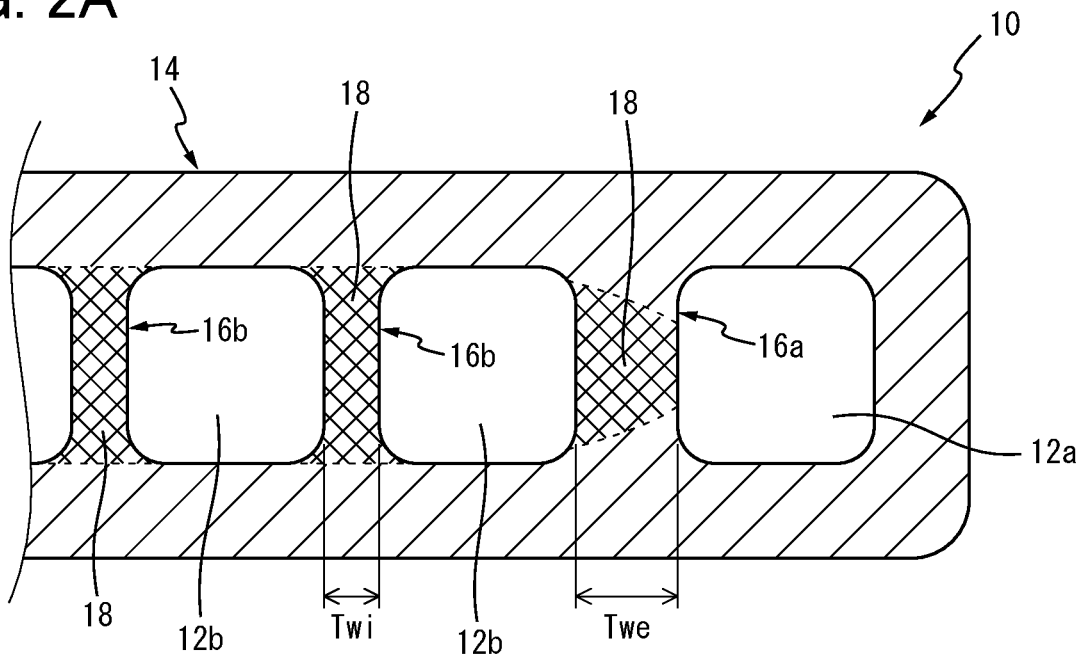
FIGS. 2A and 2B are schematic cross sectional views showing flat aluminum extruded multi-port tubes according to other embodiments of the present invention, in which FIG. 2A schematically shows a view corresponding to the embodiment shown in FIG. 1C
Figure 2B:
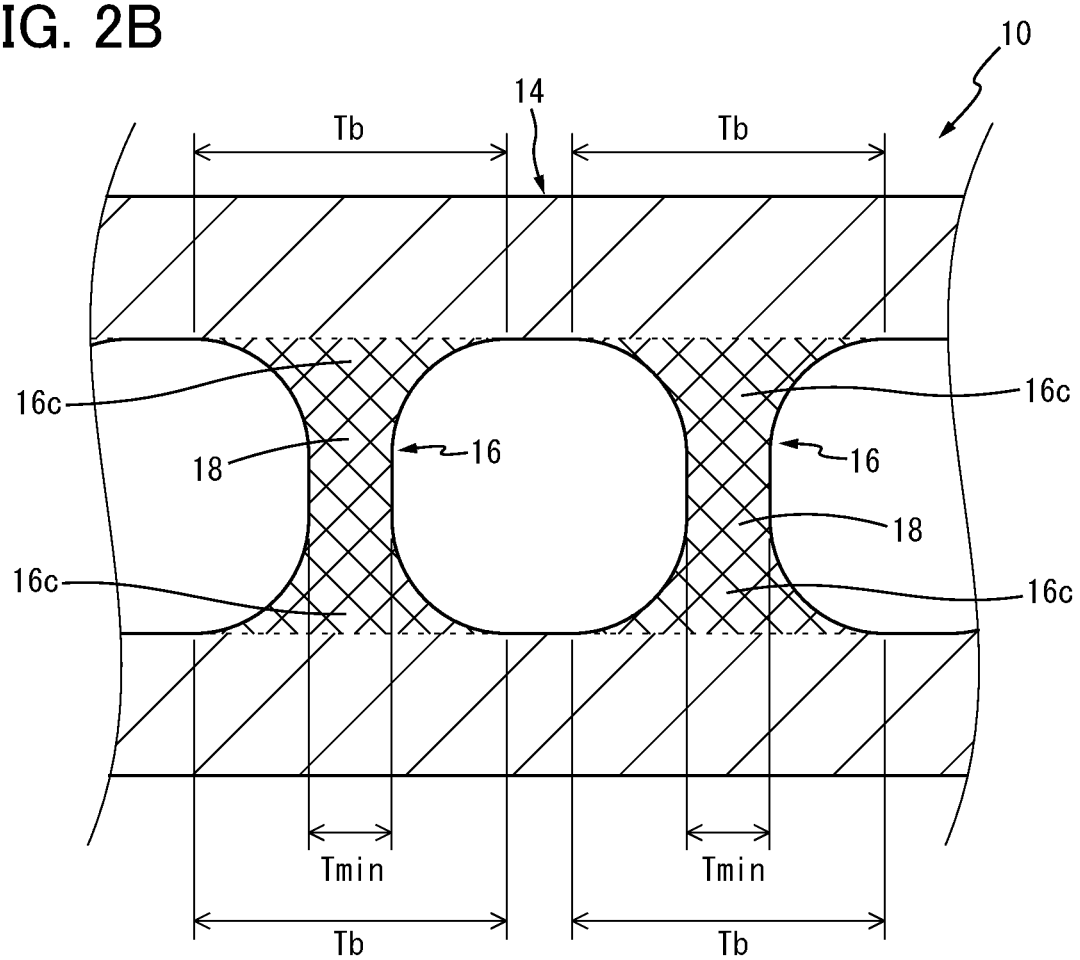

As shown in FIG. 1C and FIG. 2A, in the case where the sacrificial anode portion 18 exists at the internal partition wall portions 16 (16*a*, 16*b*), and hardly exist at the peripheral wall portions 14 or a thickness of the sacrificial anode portion 18 at the peripheral wall portions 14 is smaller than that of the internal partition wall portions 16, the internal partition wall portions 16 are preferentially subjected to the corrosion, in particular in the connecting parts 16*c* connecting the internal partition wall portions 16 to the peripheral wall portions 14. Thus, in the invention, as shown in FIG. 2B, it is advantageous that a width Tb of the connecting parts 16*c* connecting the internal partition wall portions 16 to the peripheral wall portion 14 is made larger than a minimum thickness (a thickness of the portion whose wall thickness is the smallest) Tmin of the internal partition wall portions 16, so as to advantageously compensate for a decrease of thickness by the corrosion of the connecting parts 16*c* of the internal partition wall portions 16. That is, it is preferable that the internal partition wall portions 16 positioned between adjacent ones of the plurality of flow passages extend with a thickness increasing continuously or stepwise from the thinnest part of the internal partition wall portions 16 toward opposite sides of the peripheral wall portions 14 which are joined by the internal partition wall portions 16, and are joined to those opposite sides of the peripheral wall portion 14 (upper and lower parts in FIG. 2B) by the connecting parts 16*c*, 16*c* having a thickness (width) larger than that of the part having the smallest wall thickness Tmin of the internal partition wall portions 16. Here, it is noted that the width Tb of each connecting part 16*c* is defined by a distance between the two parts at each of the opposite ends of the internal partition wall portion 16, which two parts are adjacent to the peripheral wall portion 14, and partially constitute the internal partition wall portion 16 (connecting part 16*c*).

Figure 3A:
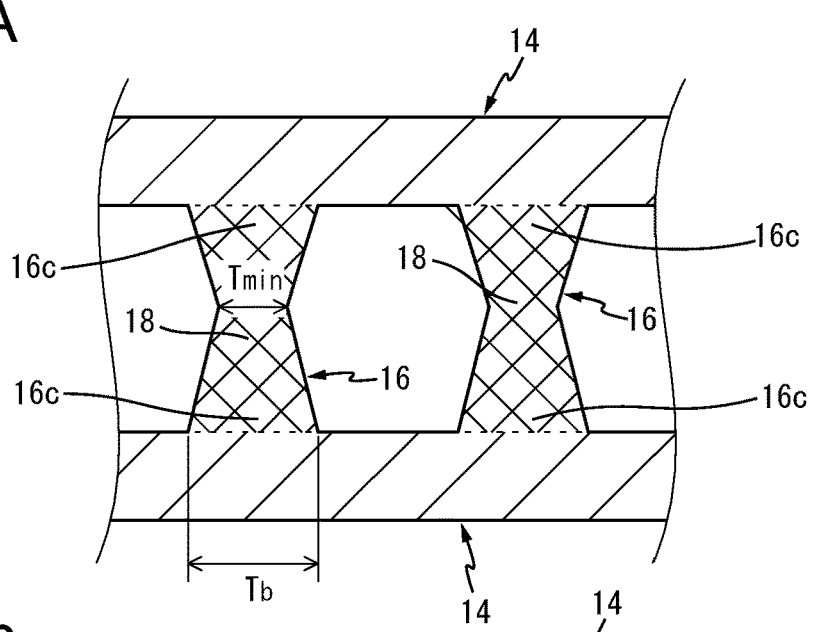
Figure 3B:
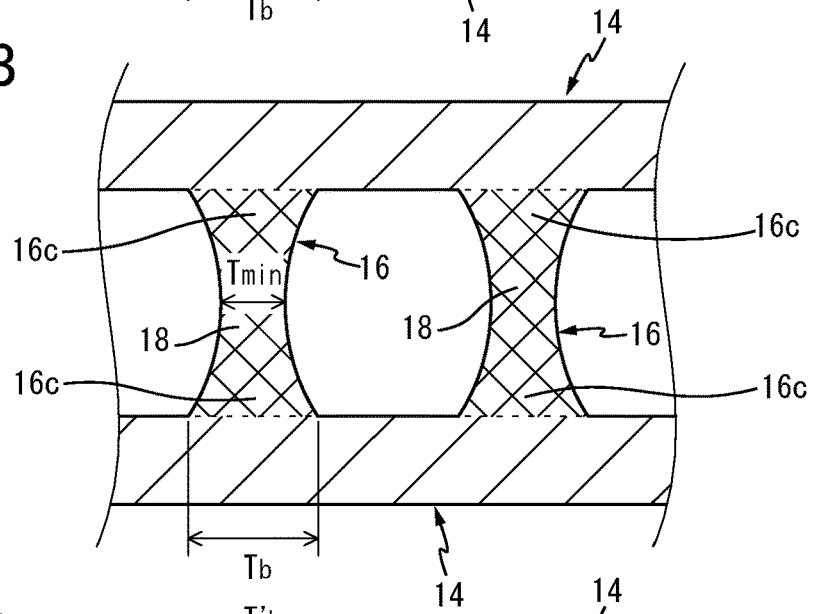
Figure 3C:
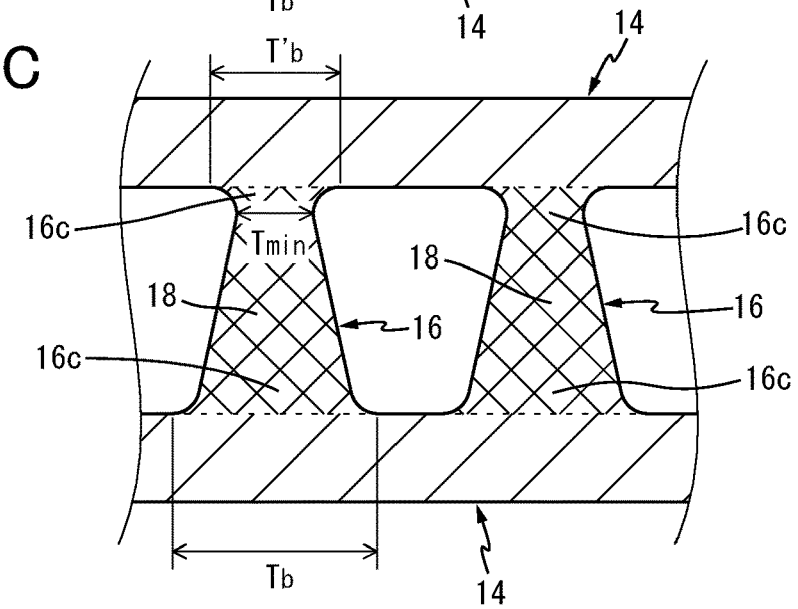
Figure 4:
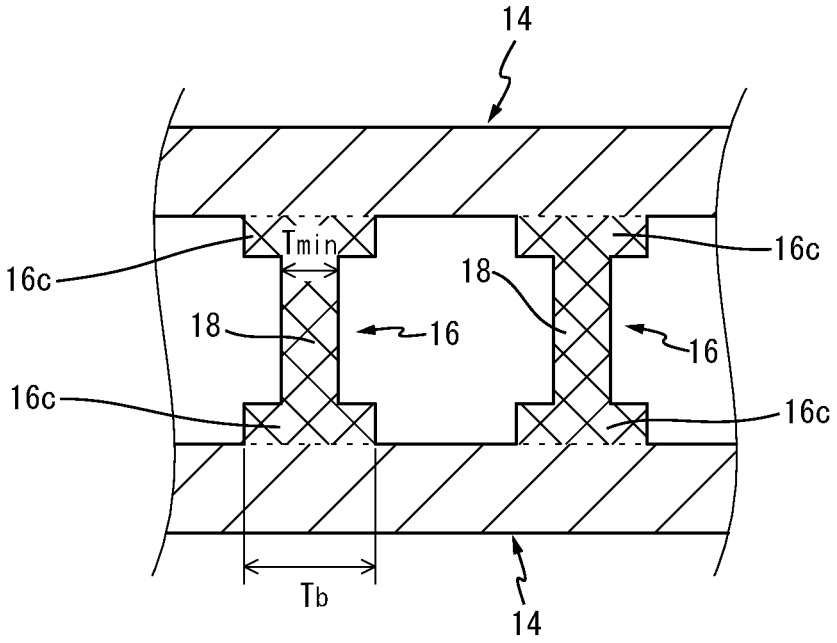
FIG. 4 is a schematic cross sectional view showing another form of the internal partition wall portions in the flat aluminum extruded multi-port tube according to the present invention.

The preferred form of the connecting parts 16*c* in the invention is never limited to the shape shown in FIG. 2B, and the shapes shown in FIG. 3 and FIG. 4, for example, can be employed. More particularly, FIG. 3A shows a form wherein the thickness of the internal partition wall portion 16 changes lineally from the thinnest part; FIG. 3B shows a form wherein the thickness of the internal partition wall portion 16 increases curvedly from the thickness Tmin of the thinnest portion; and FIG. 3C shows a form wherein the part of the internal partition wall portion 16 having the minimum thickness is adjacent to the upwardly located peripheral wall portion 14 in the figure, the thickness of the internal partition wall portion 16 increases lineally or curvedly toward the upwardly and downwardly located peripheral wall portions 14, and the internal partition wall portion 16 is connected to the upwardly and downwardly located peripheral wall portions 14, 14. In addition, in the form shown in FIG. 3C the upper and lower connecting parts 16*c*, 16*c* of the internal partition wall portion 16 have different widths (T'b<Tb). Furthermore, in FIG. 4, the part of the internal partition wall portion 16 having the minimum thickness exists for a predetermined length in the vertical direction, and the wall thickness stepwise (in steps) increases from the opposite ends of the internal partition wall portion 16 so as to be connected to the upwardly and downwardly located peripheral wall portions 14, 14. While the opposite ends of the internal partition wall portion 16 have the same shape in this example, they may have different shapes. It is to be understood that the shape of the internal partition wall portion 16 connected to the peripheral wall portion 14 via the connecting parts 16*c* according to the invention may be changed based on the knowledge of one skilled in the art.

The above-described flat aluminum extruded multi-port tube according to the invention is used advantageously as a flow passage member for a refrigerant in a heat exchanger. In the case where the flat multi-port tube according to the invention is used as a passageway tube for the refrigerant, the heat exchanger comprises, for example: a pair of aluminum header tanks spaced apart from each other; a plurality of flat multi-port tubes which are arranged between the two header tanks at a spacing interval in parallel to each other in a longitudinal direction of the header tanks, with their width direction being parallel to the ventilation direction, such that the opposite ends of each flat multi-port tube are connected to the respective header tanks; outer fins in the form of aluminum corrugate fins which are disposed in the spaces between the adjacent flat multi-port tubes and outwardly of the flat multi-port tubes at the opposite ends of the arrangement, and which are joined to the flat multi-port tubes by brazing; and aluminum side plates disposed outwardly of the corrugate fins and joined to the fins by brazing. It is needless to say that the flat multi-port tube according to the invention may be used as the passageway tube for the refrigerant in various known heat exchangers other than the heat exchanger having the above-described configuration.

As known well, in the heat exchanger, the refrigerant or cooling agent is distributed from one of the pair of the header tanks into the flat multi-port tubes, and is discharged from the flat multi-port tubes to flow into the other header tank. For example, the conventional header tanks take the form of: a pair of header plates opposed to each other and brazed to the flat multi-port tubes; a pair of plates each of which is annularly bent such that the plate is welded or brazed at its opposite ends; and a pair of annularly extruded tubes.

Although one typical embodiment of the invention has been described in detail for illustration purpose only, it is to be understood that the invention is not limited to the details of the preceding embodiment.

It is to be understood that the present invention may be embodied with various changes, modifications and improvements which may occur to those skilled in the art, without departing from the spirit and scope of this invention, and that such changes, modifications and improvements are also within the scope of this invention.

EXAMPLES

To clarify the present invention more specifically, some typical examples of the present invention will be described. However, it is to be understood that the invention is not limited to the details of the examples.

Example 1

To produce flat multi-port tubes according to the invention, composite billets (a)-(h) were prepared, which billets comprise tube materials and sacrificial anode materials having compositions (%: by mass) shown in the following Table 1, and each of the composite billets was subjected to a hot extrusion so that flat multi-port tubes A-H were obtained. As Comparative Examples, a single-component billet (i) and a composite billet (j) having the compositions shown in Table 1 were produced as well so that flat multi-port tubes I and J were obtained by subjecting each of the billets to the hot extrusion. The obtained flat multi-port tubes A-J were then evaluated by the following (1) measurement of a range of formation of a sacrificial anode portion, (2) measurement of an electric potential and (3) evaluation of a corrosion-resistance.

TABLE 1

| | | Composition of billet | |
|---|---|---|---|
| | Kind of billet | Tube material | Sacrificial anode material |
| Present invention | (a) | Al—0.4%Cu | Al—2%Zn |
| | (b) | Al—0.4%Cu | Al—0.2%Zn |
| | (c) | Al—0.4%Cu | Al—0.5%Zn |
| | (d) | Al—0.4%Cu | Al—1%Zn |
| | (e) | Al—0.4%Cu | Al—3%Zn |
| | (f) | Al—0.4%Cu | Al—8%Zn |
| | (g) | JIS A3003 alloy | Al—2%Zn |
| | (h) | Al—0.4%Cu | Al—2%Zn |
| Comparative examples | (i) | Al—0.4%Cu | — |
| | (j) | Al—0.4%Cu | Al—2%Zn |

Figure 5:
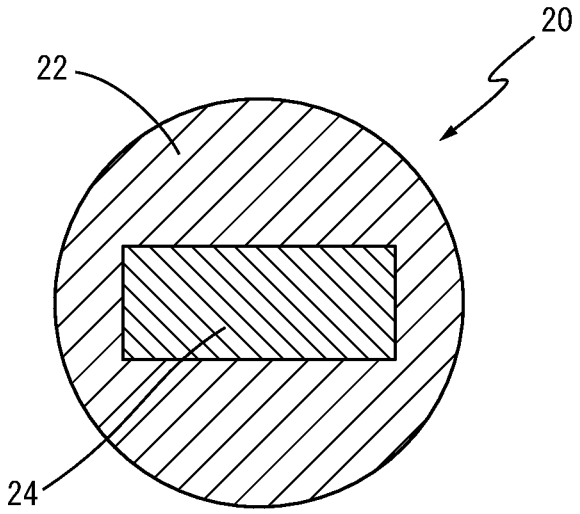
FIG. 5 is a schematic view showing a transverse section of a composite billet used in Examples.
Figure 6:
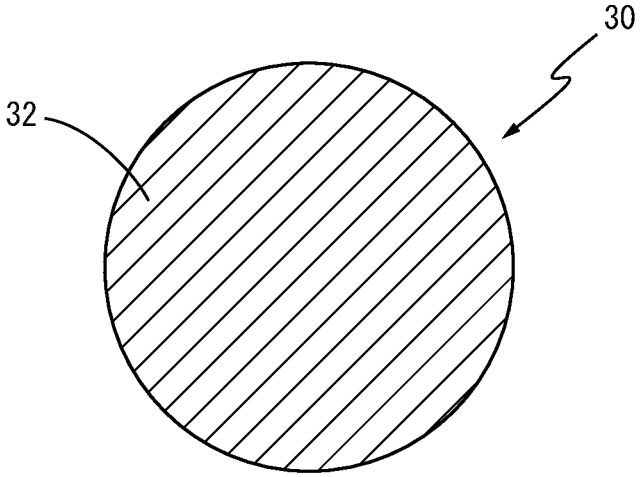
FIG. 6 is a schematic view showing a transverse section of a single-component billet used in Comparative Examples.

More particularly, various cylindrical billets with a diameter of 90 mmϕ for use as tube materials were produced by a conventional DC casting process according to the compositions of the tube materials for the billets (a)-(h) according to the invention and the comparative billet (j) shown in Table 1. On the other hand, various billets for use as sacrificial anode materials were similarly produced according to the compositions of the sacrificial anode materials for the billets (a)-(h) according to the invention and the comparative billet (j) shown in Table 1. These billets for use as the sacrificial anode materials were formed so as to have rectangular cross sectional shapes with respective combinations of length and width dimensions within a range of 30 mm-85 mm. The sacrificial anode material billet for the comparative billet (j) was formed to have a 70 mm×70 mm square cross sectional shape. Then, a through-hole into which the thus formed sacrificial anode material billet can be inserted was formed through a central part of the cross section of each of the above-described tube material billets, and the sacrificial anode material billet was inserted into the through-hole. Further, the tube material billet and the sacrificial anode material billet were fixed and joined together by MIG welding at the opposite longitudinal end faces of the tube material billet, so that each of the composite billets (a)-(h) and (j) was produced as an integral composite billet 20 having the cross sectional shape shown in FIG. 5. As a comparative example, a single-component billet having the composition of the tube material for the comparative billet (i) shown in Table 1 was produced. This single-component billet having the alloy composition of the comparative billet (i) is the single-component billet 30 shown in FIG. 6, equivalent to a conventional billet which does not include a sacrificial anode material billet. In FIGS. 5 and 6, numerals 22 and 32 represent the tube material billets, and 24 represents the sacrificial anode material billet.

Next, the thus obtained composite billet 20 or the single-component billet 30 was heated to 500° C. in a billet heater, and subjected to the hot extrusion by using a conventional porthole die having extruding holes to form eight rectangular holes (eight flow passages), so that the flat multi-port tubes A-H and I-J (total thickness: 2.0 mm, width in the flat direction: 16 mm, and thicknesses of the peripheral wall portion and internal partition wall portion: 0.25 mm) were produced.

(1) Measurement of the Range of Formation of the Sacrificial Anode Portion

The thus obtained various flat multi-port tubes (10) having eight holes were cut at a ½ position in the extruding longitudinal direction, and their cross sectional surfaces were examined. More particularly, the range of formation of the sacrificial anode portion (18) was evaluated by measuring, with a ruler, a region of the sacrificial anode portion (18) in a microphotograph of 25-times magnification of the cross sectional surface. With respect to the above-described measurement of the range of formation of the sacrificial anode portion (18), the results were evaluated as "Good" if the range was not less than 10% of the peripheral length of the flow passage (12) (the total length of the four walls of the rectangular flow passage), and as "Poor" if the range was not less than 0% and less than 10% of the peripheral length. The thickness of the sacrificial anode portion (18) at the internal partition wall portion (16) partially defining the adjacent flow passages was evaluated as "Good" if the thickness of the sacrificial anode portion (18) was more than 0% and not more than 100% of the thickness of the internal partition wall portion (16), and as "Poor" if the thickness of the sacrificial anode portion (18) was 0% of the thickness of the internal partition wall portion (16). Furthermore, the thickness of the sacrificial anode portion (18) at the peripheral wall portion (14) was evaluated as "Good" if the thickness of the sacrificial anode portion (18) was not more than 90% of the thickness of the peripheral wall portion (14), and as "Poor" if the thickness of the sacrificial anode portion (18) was more than 90% of the thickness of the peripheral wall portion (14). In the following Table 2, the results of the above measurement of the range of formation of the sacrificial anode portion (18) with respect to each of the flat multi-port tubes A-H according to the invention and the flat multi-port tubes I and J according to the comparative examples are shown in terms of the smallest one of values of the peripheral length of the sacrificial anode portion (18) exposed to the respective flow passages, and the largest one of values of the thickness of the sacrificial anode portion (18) at the internal partition wall portion (16) and the peripheral wall portion (14) exposed to the flow passages.

TABLE 2

| | Kind of flat multi-port tube | State of formation of sacrificial anode portion (18) | | | | | |
|---|---|---|---|---|---|---|---|
| | | Peripheral length (%) (smallest value) | Evaluation | Thickness of partition wall portion (%) (largest thickness) | Evaluation | Thickness of peripheral wall portion (%) (largest thickness) | Evaluation |
| Present invention | A | 95 | Good | 100 | Good | 80 | Good |
| | B | 80 | Good | 100 | Good | 70 | Good |
| | C | 85 | Good | 100 | Good | 75 | Good |
| | D | 50 | Good | 60 | Good | 50 | Good |
| | E | 30 | Good | 30 | Good | 40 | Good |
| | F | 50 | Good | 60 | Good | 50 | Good |
| | G | 95 | Good | 100 | Good | 80 | Good |
| | H | 10 | Good | 100 | Good | 80 | Good |
| Comparative examples | I | 0 | Poor | 0 | Poor | 0 | Poor |
| | J | 0 | Poor | 100 | Good | 93 | Poor |

According to the examination of the cross sectional surfaces, it was confirmed that, with respect to the flat multi-port tubes A-H obtained by the extrusion according to the invention, the sacrificial anode portion (18) prepared with the sacrificial anode material billet was formed at all of the internal partition wall portions (16) positioned between the adjacent flow passages (12), with the thickness of the sacrificial anode portion (18) not more than 100% of the thickness of the internal partition wall portion (16). It was also confirmed that the thickness of the sacrificial anode portion (18) formed at any part of the peripheral wall portion (14) was not more than 80% of the thickness of the internal partition wall portion (16). Furthermore, it was confirmed that the sacrificial anode portion (18) was exposed to all of the flow passages (12) of the flat multi-port tubes (10) along the length more than 0% of the peripheral length of each of the flow passages (12).

It was also confirmed, with respect to the flat multi-port tubes (10) obtained by the hot extrusion as described above, that the sacrificial anode portion (18) formed from the sacrificial anode material billet was stably exposed to the inner surfaces of the flow passages (12) in the longitudinal direction of the extrusion.

On the other hand, the sacrificial anode portion (18) of the flat multi-port tube I obtained by subjecting the single-component billet 30 having the composition (i) of the comparative example to the hot extrusion with the porthole die did not have any exposed part, since no sacrificial anode material billet was used. With respect to the flat multi-port tube J according to the comparative example, which tube was obtained from the composite billet prepared by forming an Al-2% Zn billet into a shape of 70 mm×70 mm square, it was confirmed that the sacrificial anode portion (18) formed from the sacrificial anode material billet was exposed by the thickness of not more than 100% of the thickness of the internal partition wall portion (16) in the central part of the tube J in the width direction. The thickness of the thickest part of the sacrificial anode portion (18) formed in the peripheral wall portion (14) was 93% of the thickness of the peripheral wall portion (14). However, the sacrificial anode portion (18) was not exposed at all to some parts of the flow passages (12) at the opposite end portions in the width direction of the tube J, so that the smallest value of the peripheral length (%) was 0%.

(2) Measurement of the Electric Potential

With respect to each of the flat multi-port tubes A-H according to the invention and the flat multi-port tubes I and J according to the comparative examples which were obtained as described above, the electric potential of each of the tube material and the sacrificial anode material was measured. It is noted that the flat multi-port tube I according to the comparative example was formed from the single-component billet consisting solely of the tube material and did not have any sacrificial anode portion (18).

More specifically, each of the flat multi-port tubes A-H according to the invention and the flat multi-port tubes I and J according to the comparative examples was subjected to the heat treatment at 600° C. for 3 minutes in view of heating of the tube upon brazing for joining of the fins where the tube is used as a heat transfer tube for a heat exchanger, and was cut into pieces each having a length of 40 mm in the longitudinal direction of the extrusion. With respect to the sample piece for measuring the electric potential of the tube material, the entirety of the piece other than one of the opposite end faces to which a lead line for electric measurement was connected was masked with a silicone resin so as to be electrically insulated, such that a 10 mm×10 mm area in a central part of one of the opposite outer surfaces of the peripheral wall portion of the tube material in the width direction of the tube was kept exposed. Furthermore, the sample piece for measuring the electric potential of the sacrificial anode portion (18) (sacrificial anode material) was cut into two half pieces in a plane extending in the longitudinal direction (axial direction of the tube) of the cross sectional flat shape such that the thickness of each half piece was ½ of the thickness of the original sample piece, and the entirety of each of the two half pieces other than the end face to which the lead line for electric measurement was connected was masked with the silicone resin, such that a 10 mm×10 mm area in a central part of the sacrificial anode portion (18) in the width direction of the half piece remains exposed, so as to be electrically insulated.

To measure the electric potential, the following method was employed: as a reference electrode, a saturated KCl calomel electrode (SCE) was used, while a 5% NaCl solution adjusted to have pH3 with an acetic acid was used as a test solution; the solution was stirred at room temperature; the sample was immersed in the solution for 24 hours; and then the electric potential of each of the samples was measured.

The result obtained by the above measurement with respect to the differences of the electric potential between the tube materials and the sacrificial anode materials is shown in Table 3 below. The differences of the electric potential between the tube materials and the sacrificial anode materials are evaluated as "Excellent" where the difference is not less than 5 mV and not more than 300 mV, "Good" where the difference is more than 0 mV and less than 5 mV or more than 300 mV, and "Poor" where the difference is 0 mV.

TABLE 3

| | Kind of flat multi-port tube | Difference of potential (mV) | Evaluation |
|---|---|---|---|
| Present invention | A | 150 | Excellent |
| | B | 3 | Good |
| | C | 10 | Excellent |
| | D | 100 | Excellent |
| | E | 250 | Excellent |
| | F | 350 | Good |
| | G | 100 | Excellent |
| | H | 150 | Excellent |
| Comparative examples | I | 0 | Poor |
| | J | 150 | Excellent |

As is apparent from the result of measurement of the electric potential shown in Table 3, each of the flat multi-port tubes A-H according to the invention has the difference of the electric potential of 3-350 mV between the sacrificial anode portion (18) (the sacrificial anode material) and the tube material after the expected heating for brazing, indicating that a sufficient sacrificial anode effect was achieved.

On the other hand, with respect to the sample based on the flat multi-port tube I according to the comparative example, the difference of the electric potential was 0 mV since the flat multi-port tube was formed only from the tube material as the conventional tube, without including the sacrificial anode material.

Furthermore, the difference of the electric potential was measured by the same method as described above with respect to the sample based on the flat multi-port tube J according to the comparative example, as well. The difference of the electric potential between the sacrificial anode portion (18) (the sacrificial anode material) and the tube material after the expected heating for brazing was 150 mV, indicating that a sufficient sacrificial anode effect was achieved.

(3) Evaluation of the Corrosion-Resistance

With respect to each of the flat multi-port tubes A-H according to the invention and the flat multi-port tubes I and J according to the comparative examples which were obtained as described above, the OY water (Old Yokohama river water) immersion test was performed to evaluate the corrosion-resistance effect of the inner surfaces of each tube. It is noted that the OY water immersion test is a method of evaluating the corrosion-resistance of the inner surfaces including the following steps. First, sodium chloride: 0.026 g, sodium sulfate (anhydride): 0.089 g, cupric chloride (dihydrate): 0.003 g and ferric chloride (hexahydrate): 0.145 g are dissolved in 1 L of pure water to obtain a test solution, and only the inner surfaces of the above-described samples are exposed to and immersed in the test solution. Then, the samples are held at 80° C. for 8 hours, and then held at room temperature for 16 hours. The above steps constitute one cycle, and the cycle is repeated 30, 60 or 90 times.

Described more specifically, each of the flat multi-port tubes A-H according to the invention and the flat multi-port tubes I and J according to the comparative examples was subjected to the heat treatment at 600° C. for 3 minutes in view of heating of the tube upon brazing for joining of the fins where the tube is used as a heat transfer tube for a heat-exchanger, and was cut into pieces each having a length of 100 mm in the longitudinal direction of the extrusion. Then, outer surfaces and opposite end faces of the samples were all masked with a silicone resin to be electrically insulated. Subsequently, the samples masked with the silicone resin were kept immersed in the above-described OY test solution for 8 hours, while the OY test solution was stirred at 80° C., and further held for 16 hours after the heating and stirring operations were stopped. The above steps constituted one cycle, and the cycle was repeated 30, 60 and 90 times for each tube so that the corrosion-resistance of the tube was evaluated for three different periods of time.

With respect to each of the samples subjected to the above-described test of evaluation of the corrosion-resistance, the silicone sealant resin on the surfaces of the samples was peeled off, and then a product generated as a result of the corrosion on the surfaces of the samples was removed by immersing the sample in a phosphoric acid/chromic acid solution whose temperature was raised by a heater. The samples were examined as to whether they had penetration holes on their surfaces or not. Furthermore, the samples whose corrosion products were peeled off were cut into two half pieces in a plane extending in the longitudinal direction (axial direction) of the tube having the cross sectional flat shape, such that the thickness of each piece was ½ of the thickness of the original sample. Each of the two half pieces was covered with an embedding resin, subjected to a cross section processing by a water-proof paper with respect to the maximum corrosion portion, and further subjected to a mirror finish by buffing. Then, the corrosion state of the inner surfaces of the flow passages of each sample was examined. It is noted that, with respect to the samples used in the above-described test, the result is evaluated as "Excellent" in the case where the penetration did not occur after 60 cycles but occurred after 90 cycles, or no penetration occurred at all; "Good" in the case where the penetration did not occur after 30 cycles but occurred after 60 cycles; and "Poor" in the case where the penetration occurred after 30 cycles.

In Table 4, the result of the above-described OY water immersion test in terms of 30, 60 and 90 cycles performed on each of the flat multi-port tubes A-H according to the invention and the flat multi-port tubes I and J according to the comparative examples is shown.

TABLE 4

| | Kind of flat multi-port tube | Result of OY water immersion test | Evaluation |
|---|---|---|---|
| Present invention | A | No penetration | Excellent |
| | B | Penetration after 60 cycles | Good |
| | C | Penetration after 60 cycles | Good |
| | D | Penetration after 90 cycles | Excellent |
| | E | No penetration | Excellent |
| | F | Penetration after 60 cycles | Good |
| | G | Penetration after 90 cycles | Excellent |
| | H | Penetration after 60 cycles | Good |

TABLE 4-continued

| | Kind of flat multi-port tube | Result of OY water immersion test | Evaluation |
|---|---|---|---|
| Comparative examples | I | Penetration after 30 cycles | Poor |
| | J | Penetration after 30 cycles | Poor |

As is apparent from the result shown in Table 4, it was recognized that the flat multi-port tubes A-H according to the invention did not suffer from generation of any penetration holes formed through the tube peripheral portion, with respect to the evaluation after 30 cycles of the OY water immersion test. With respect to the evaluation after 60 cycles, penetration holes formed through the tube peripheral portion were observed in the flat multi-port tubes B, C, F and H. Furthermore, with respect to the evaluation after 90 cycles, no penetration hole formed through the tube peripheral portion was observed in any of the flat multi-port tubes except for the flat multi-port tubes B, C, F and H. Therefore, it was recognized that all of the flat multi-port tubes A-H according to the invention enjoyed the sufficient internal corrosion-resistance owing to the sacrificial anode effect by the existence of the sacrificial anode portion (18).

On the other hand, since the flat multi-port tube I according to the comparative example was the tube wherein only the conventional tube material was employed and the sacrificial anode material was not included, it was found that corrosion holes formed through the tube peripheral portion were generated with respect to the evaluations after all of the OY water immersion tests of 30, 60 and 90 cycles. It was recognized that the penetration occurred at an early stage because the tube did not have the sacrificial anode portion (18) around the flow passages, contrary to the flat multi-port tubes according to the invention, and the tube did not enjoy the sacrificial anode effect to achieve the intended internal corrosion-resistance.

With respect to the flat multi-port tube J according to the comparative example, it was found that corrosion holes formed through the peripheral wall portion were generated with respect to the evaluations after all of 30, 60 and 90 cycles of the same OY water immersion test as described above. The formation of the corrosion holes was observed at the opposite end portions in the width direction of the flat multi-port tubes, wherein the sacrificial anode portion (18) was not formed. It was recognized that, as in the case of the above-described flat multi-port tube I, the penetration occurred at an early stage because the tube did not have the sacrificial anode portion (18) around the flow passages and the tube did not enjoy the sacrificial anode effect to achieve the intended internal corrosion-resistance.

Example 2

As in Example 1, the composite billet (a) obtained in Example 1 was subjected to the hot extrusion using a plurality of porthole dies having a different size of portholes, so that the flat multi-port tubes AA to AH shown in the following Table 5, which tubes have eight rectangular holes (eight flow passages) shown in FIGS. 2A and 2B, were produced. The obtained various flat multi-port tubes were examined with respect to their transverse sections, and measured with respect to the thickness (Twi) of the internal partition wall portions (16*b*) in their central part in the width direction of the tube, the thickness (Twe) of the internal partition wall portions (16*a*) at their end portions in the width direction of the tube, the thickness (Tmin) of the thinnest part of the internal partition wall portions (16), and the width (Tb) of the upper and lower connecting parts (16*c*) of the internal partition wall portions (16). The result is shown in Table 5.

TABLE 5

| Kind of flat multi-port tube | Structure of flat multi-port tube | | | |
|---|---|---|---|---|
| | Thickness of internal partition wall portion in central part in the width direction (Twi: mm) | Thickness of internal partition wall portion at end portions in the width direction of tube (Twe: mm) | Thickness of thinnest part of internal partition wall portion (Tmin: mm) | Width of connecting parts of internal partition wall portion (Tb: mm) |
| AA | 0.2 | 0.2 | 0.2 | 0.7 |
| AB | 0.2 | 0.3 | 0.2 | 0.7 |
| AC | 0.16 | 0.4 | 0.16 | 0.66 |
| AD | 0.16 | 0.4 | 0.16 | 0.8 |
| AE | 0.2 | 0.2 | 0.2 | 0.9 |
| AF | 0.24 | 0.4 | 0.24 | 1 |
| AG | 0.2 | 0.2 | 0.2 | 0.2 |
| AH | 0.2 | 0.3 | 0.2 | 0.2 |

With respect to each of the obtained flat multi-port tubes AA to AH, the range of formation of the sacrificial anode portion (18) in the transverse section was measured as in the case of the above-described Example 1, and the result is shown in the following Table 6 as the state of formation of the sacrificial anode portion (18). Furthermore, each of the flat multi-port tubes was subjected to 30, 60 and 90 cycles of the OY water immersion test as in the case of Example 1 to evaluate the corrosion-resistance, and the test result is shown in Table 6. It is noted that, in the OY water immersion test, the result is evaluated as "Excellent" in the case where the penetration into the internal partition wall portions (16) did not occur after 60 cycles but occurred after 90 cycles, or no penetration occurred at all; "Good" in the case where the penetration into the internal partition wall portions (16) did not occur after 30 cycles but occurred after 60 cycles; and "Poor" in the case where the penetration into the internal partition wall portions (16) occurred after 30 cycles.

TABLE 6

| | State of formation of sacrificial anode portion (18) | | | | | OY water immersion test | |
|---|---|---|---|---|---|---|---|
| Kind of flat multi-port tube | Flow passages (12a) at and portions in direction Peripheral length (%) | Flow passages (12b) in central part in the width direction Smallest value of peripheral length (%) | Internal partition wall portion (16a) at end portions in the width direction Largest thickness (%) | Internal partition wall portions (16b) in central part in the width direction Largest thickness (%) | Peripheral wall portion (14) of each flow passage Largest thickness (%) | Corrosion state of internal partition wall portions (16a) at end portions in the width direction | Corrosion state of connecting parts (16c) of internal partition wall portions |
| AA | 20 | 50 | 100 | 100 | 0 | Poor | Good |
| AB | 20 | 50 | 100 | 100 | 0 | Excellent | Good |
| AC | 20 | 50 | 100 | 100 | 0 | Excellent | Good |
| AD | 20 | 50 | 100 | 100 | 0 | Excellent | Excellent |
| AE | 20 | 50 | 100 | 100 | 0 | Poor | Excellent |
| AF | 20 | 50 | 100 | 100 | 0 | Excellent | Excellent |
| AG | 20 | 50 | 100 | 100 | 0 | Poor | Poor |
| AH | 20 | 50 | 100 | 100 | 0 | Good | Poor |

As shown in Table 6, with respect to each of the flat multi-port tubes AA to AH, the ratio of the existence of the sacrificial anode portion (18) in the peripheral wall portions (14) partially defining the flow passages (12*a*) positioned at the opposite end portions was 0% and the tube material was exposed to the inner surfaces of the flow passages, while the sacrificial anode portion (18) were formed at the internal partition wall portions (16*a*) separating the flow passages (12*a*) positioned at the opposite end portions from the flow passages (12*b*) adjacent to them, with a thickness equivalent to that of the end portions of the internal partition wall portions (16*a*). The ratio of exposure of the sacrificial anode portion (18) was equivalent to 20% of the entire peripheral length of the flow passages (12*a*) positioned at the opposite end portions. The ratio of existence of the sacrificial anode portion (18) at the peripheral wall portions (14) defining the flow passages (12*b*) positioned at locations other than the opposite end portions of the tube in the width direction was 0% and the tube material was exposed to the inner surfaces of the flow passages, while the sacrificial anode portion (18) was formed at the internal partition wall portions (16*b*) defining the flow passages (12*b*) positioned at the locations other than the opposite end portions of the tube in the width direction, with a thickness equivalent to that of the internal partition wall portions (16*b*). The smallest value of the ratio of exposure of the sacrificial anode portion (18) was equivalent to 50% of the entire peripheral length of the flow passages (12*b*).

As the result of the OY water immersion test with respect to the flat multi-port tubes AA to AH, it was found that each of the flat multi-port tubes did not suffer from generation of corrosion holes formed through its peripheral wall portions (14) even after 90 cycles of the test.

As to the corrosion of the internal partition wall portions (16) in each of the flat multi-port tubes AA, AE and AG, the sacrificial anode portion (18) at the internal partition wall portions (16*a*) partially defining the flow passages (12*a*) positioned at the end portions in the width direction were preferentially subjected to the corrosion, so that corrosion holes formed through the internal partition wall portions (16*a*) were observed after 30 cycles of the OY water immersion test. In the flat multi-port tubes AB-AD and AF, the thickness (Twe) of the internal partition wall portions (16*a*) partially defining the flow passages (12*a*) positioned at the opposite end portions in the width direction of the flat multi-port tube was set to be larger than the thickness (Twi) of the internal partition wall portions (16*b*) positioned in the central part of the flat multi-port tube in the width direction relative to the internal partition wall portions (16*a*), whereby penetration holes due to the corrosion were not generated even after 60 cycles of the OY water immersion test. Furthermore, it was found that some of the flat multi-port tubes did not suffer from corrosion holes formed through the internal partition wall portions (16*a*) positioned at the end portions even after 90 cycles of the test.

Furthermore, in the flat multi-port tubes AG and AH, because the width of the connecting parts (16*c*) of the internal partition wall portions (16) was not sufficient, the connecting parts (16*c*) in the upper and the lower parts of the internal partition wall portions (16) were preferentially subjected to the corrosion due to the difference of the electric potential, with the tube material being exposed to the inner surfaces of the flow passages (12) at the peripheral wall portions (14), whereby the penetration by the corrosion of the internal partition wall portions (16) was recognized after 30 cycles of the OY water immersion test. On the other hand, in the flat multi-port tubes AD-AF, the width (Tb) of the connecting parts (16*c*) in the upper and lower parts of the internal partition wall portions (16) was set to be larger than the thickness (Tmin) of the thinnest part of the internal partition wall portions (16) so that the preferential corrosion of the sacrificial anode portion (18) positioned in the connecting parts (16*c*) of the internal partition wall portions (16) was advantageously reduced, whereby penetration holes due to the corrosion were not generated in the internal partition wall portions (16) even after 60 cycles of the OY water immersion test. Furthermore, it was found that some of the flat multi-port tubes did not suffer from corrosion holes even after 90 cycles of the test.

DESCRIPTION OF NUMERALS

10 flat multi-port tube 12 flow passages (hollow holes)
14 peripheral wall portions 16 internal partition wall portions
18 sacrificial anode portion
20 composite billet
30 single-component billet
22, 32 tube billet
24 sacrificial anode billet

The invention claimed is:

1. An aluminum multi-port tube with a flat cross sectional shape obtained by extruding an aluminum material, the aluminum multi-port tube being an extruded tube which has a plurality of flow passages extending independently of each other in an axial direction of the tube, the flow passages being arranged in a longitudinal direction of the flat cross sectional shape via internal partition wall portions extending in the axial direction of the tube in a peripheral wall portion of the tube, wherein:

the aluminum multi-port tube is formed by extrusion wherein an aluminum tube material and an aluminum sacrificial anode material having an electrochemically lower potential than the aluminum tube material are employed as said aluminum material, a difference of the potential between the aluminum tube material and the aluminum sacrificial anode material being in a range from 100 mV to 300 mV, and the aluminum sacrificial anode material is exposed to form a sacrificial anode portion at least in a part of an inner circumferential portion in cross section of each of the plurality of flow passages, whereby the aluminum multi-port tube has an internal corrosion-resistance, and the internal partition wall portions positioned at opposite end portions in the longitudinal direction of the flat cross sectional shape, among the internal partition wall portions existing between adjacent ones of the plurality of flow passages, have a larger thickness than that of the other internal partition wall portions.

2. The aluminum multi-port tube according to claim 1, wherein the internal partition wall portions are formed of the sacrificial anode portion.

3. The aluminum multi-port tube according to claim 1, wherein, in the inner circumferential portion in the cross section of each of the plurality of flow passages, the aluminum sacrificial anode material is exposed to form the sacrificial anode portion in the internal partition wall portions, while the aluminum tube material is exposed in the peripheral wall portion of the tube other than the internal partition wall portions.

4. The aluminum multi-port tube according to claim 1, wherein the sacrificial anode portion exists at the internal partition wall portion positioned between adjacent ones of the plurality of flow passages, in a ratio not higher than 100% of a thickness of the internal partition wall portion.

5. The aluminum multi-port tube according to claim 1, wherein the sacrificial anode portion exists at the peripheral wall portion other than the internal partition wall portions, in a ratio not higher than 90% of a thickness of the peripheral wall portion.

6. The aluminum multi-port tube according to claim 1, wherein the sacrificial anode portion is formed along at least 10% of a peripheral length of each flow passage in cross section of the tube, and exposed to an inner surface of the flow passage.

7. The aluminum multi-port tube according to claim 1, wherein the internal partition wall portion positioned between adjacent ones of the plurality of flow passages extends with a thickness increasing continuously or stepwise from the thinnest part of the internal partition wall portion toward opposite sides of the peripheral wall portion which are joined by the internal partition wall portion, and are joined to said opposite sides of the peripheral wall portion by connecting parts having a thickness larger than that of the thinnest part of the internal partition wall portion.

8. An aluminum heat exchanger comprising the aluminum multi-port tube according to claim 1 and aluminum outer fins brazed on an outer surface of the aluminum multi-port tube.

* * * * *